US010914490B2

(12) United States Patent
Moro et al.

(10) Patent No.: US 10,914,490 B2
(45) Date of Patent: Feb. 9, 2021

(54) INDOOR UNIT OF AN AIR-CONDITIONING APPARATUS

(71) Applicant: Mitsubishi Electric Corporation, Tokyo (JP)

(72) Inventors: Koki Moro, Tokyo (JP); Masato Ishikawa, Tokyo (JP); Masahide Kinami, Tokyo (JP); Hisanori Ikeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 205 days.

(21) Appl. No.: 16/060,061

(22) PCT Filed: Feb. 8, 2016

(86) PCT No.: PCT/JP2016/053638
§ 371 (c)(1),
(2) Date: Jun. 7, 2018

(87) PCT Pub. No.: WO2017/138065
PCT Pub. Date: Aug. 17, 2017

(65) Prior Publication Data
US 2018/0363944 A1 Dec. 20, 2018

(51) Int. Cl.
*F24F 13/20* (2006.01)
*F24F 1/0057* (2019.01)
(Continued)

(52) U.S. Cl.
CPC ..... *F24F 13/20* (2013.01); *F24F 1/0007* (2013.01); *F24F 1/0025* (2013.01); *F24F 1/0057* (2019.02); *F24F 2221/26* (2013.01)

(58) Field of Classification Search
CPC ..... F24F 13/20; F24F 1/0007; F24F 1/0057; F24F 2221/26
(Continued)

(56) References Cited

U.S. PATENT DOCUMENTS

2006/0179865 A1* 8/2006 Nakamura ..... F24F 1/0007 62/298
2008/0047288 A1* 2/2008 Nakamura ..... F24F 1/0007 62/262

FOREIGN PATENT DOCUMENTS

JP 2005-106398 A 4/2005
JP 2009-079869 A 4/2009
(Continued)

OTHER PUBLICATIONS

Best Ductless Air Conditioner Reviews, Feb. 16, 2014, Blogspot, http://ductlessairconditioner-reviews.blogspot.com/2014/02/kozykool-ductless-split-unit-air.html (Year: 2014).*
(Continued)

*Primary Examiner* — Steven B McAllister
*Assistant Examiner* — Charles R Brawner
(74) *Attorney, Agent, or Firm* — Posz Law Group, PLC

(57) ABSTRACT

An outer shell panel includes: a front panel which is provided on a front surface portion of a body casing; and side panels which are arranged on side surface portions of the body casing. The side panels each include: a base member which is provided on a side end portion of the front panel; a connecting member has a flat plate shape and has no light transmissivity, the connecting member including a first surface and a second surface formed on to the opposite side of the first surface, and being attached to the base member, with the first surface located to face the base member; and a design panel which has a flat plate shape and has light transmissivity, the design panel being attached to a peripheral edge of the connecting member to be opposite to the second surface of the connecting member.

2 Claims, 6 Drawing Sheets

(51) Int. Cl.
*F24F 1/0007* (2019.01)
*F24F 1/0025* (2019.01)

(58) Field of Classification Search
USPC ..... 454/233
See application file for complete search history.

(56) References Cited

FOREIGN PATENT DOCUMENTS

| | | | | | |
|---|---|---|---|---|---|
| JP | 2011-149634 | A | | 8/2011 | |
| JP | 2013-047589 | A | | 3/2013 | |
| JP | 2013047589 | A | * | 3/2013 | |
| WO | WO-2011055704 | A1 | * | 5/2011 | ..... F24F 1/0057 |

OTHER PUBLICATIONS

International Search Report of the International Searching Authority dated May 10, 2016 for the corresponding international application No. PCT/JP2016/053638 (and English translation).
Office Action dated May 28, 2019 issued in corresponding JP patent application No. 2017-566251 (and English translation).
Office Action dated May 28, 2019 issued in corresponding CN patent application No. 201680003272.4 (and English translation).

* cited by examiner

INDOOR UNIT OF AN AIR-CONDITIONING APPARATUS

CROSS REFERENCE TO RELATED APPLICATION

This application is a U.S. national stage application of International Application No. PCT/JP2016/053638, filed on Feb. 8, 2016, the contents of which are incorporated herein by reference.

TECHNICAL FIELD

The present invention relates to an indoor unit of an air-conditioning apparatus, and more particularly, to a member forming an outer shell of the indoor unit of an air-conditioning apparatus.

BACKGROUND

On side surfaces of an indoor unit of an air-conditioning apparatus, there are provided side panels forming outer shells of the side surfaces of the indoor unit. There has been proposed an indoor unit of an air-conditioning apparatus including side panels each including a member having light transmissivity, for example, in order to improve the design (for example, Patent Literature 1).

PATENT LITERATURE

Patent Literature 1: Japanese Unexamined Patent Application Publication No. 2009-79869

In the case where the member having light transmissivity (hereinafter also referred to as "light transmissive member") is employed as a member forming an outer shell of the indoor unit, a surface of a member that is located inward of the member having light transmissivity may be seen. There is a case where on the surface of the member located inward of the member having light transmissivity, for example, a mounting structure such as projections and recesses for use in mounting members on each other is formed. Therefore, where only a light transmissive member is employed as the member forming the outer shell of the indoor unit without careful consideration, there is a case where an internal structure of the indoor unit, such as the mounting structure, is seen through the light transmissive member, a result of which the design of the indoor unit of an air-conditioning apparatus may be worsened.

SUMMARY

The present invention has been made to solve the problem described above, and an object of the invention is to provide an indoor unit of an air-conditioning apparatus, which does not worsen the design, even when a member having light transmissivity is employed as an outer shell.

According to one embodiment of the present invention, there is provided an indoor unit of an air-conditioning apparatus, including: a body casing for receiving an indoor air-sending device configured to take in air and an indoor heat exchanger configured to exchange heat between refrigerant and the air taken in by the indoor air-sending device; and an outer shell panel which is attached to the body casing, the outer shell panel including: a front panel which is provided on a front surface portion of the body casing; and side panels which are provided on side surface portions of the body casing, the side panels each including: a base member, which is provided on a side end portion of the front panel; a connecting member which has a flat plate shape and has no light transmissivity, the connecting member including a first surface and a second surface formed on to the opposite side of the first surface, and being attached to the base member, the first surface located to face the base member; and a design panel, which has a flat plate shape and has light transmissivity, the design panel being attached to a peripheral edge of the connecting member to be located to face the second surface of the connecting member.

The indoor unit of an air-conditioning apparatus of the present invention has the above-mentioned structure, and hence does not worsen the design even in the case where a member (design panel) having light transmissivity is employed as an outer shell.

BRIEF DESCRIPTION OF DRAWINGS

FIG. 2 is a view of an internal structure of the indoor unit of an air-conditioning apparatus according to the embodiment of the present invention, as viewed side-on.

DETAILED DESCRIPTION

Figure 1:
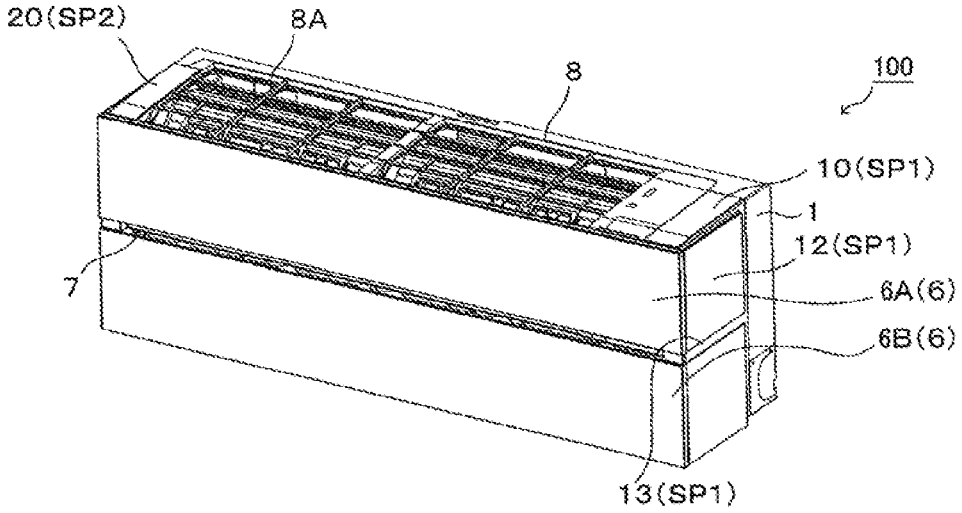
FIG. 1 is a perspective view of an indoor unit of an air-conditioning apparatus according to an embodiment of the present invention.

An indoor unit of an air-conditioning apparatus according to an embodiment of the present invention will be described with reference to the drawings. The present invention is not limited to the embodiment as described below. Moreover, in the drawings referred to below including FIG. 1, the size relationship of components may be different from that of actual components in some cases.

Embodiment

FIG. 1 is a perspective view of an indoor unit 100 of an air-conditioning apparatus according to an embodiment of the present invention.

Figure 2:
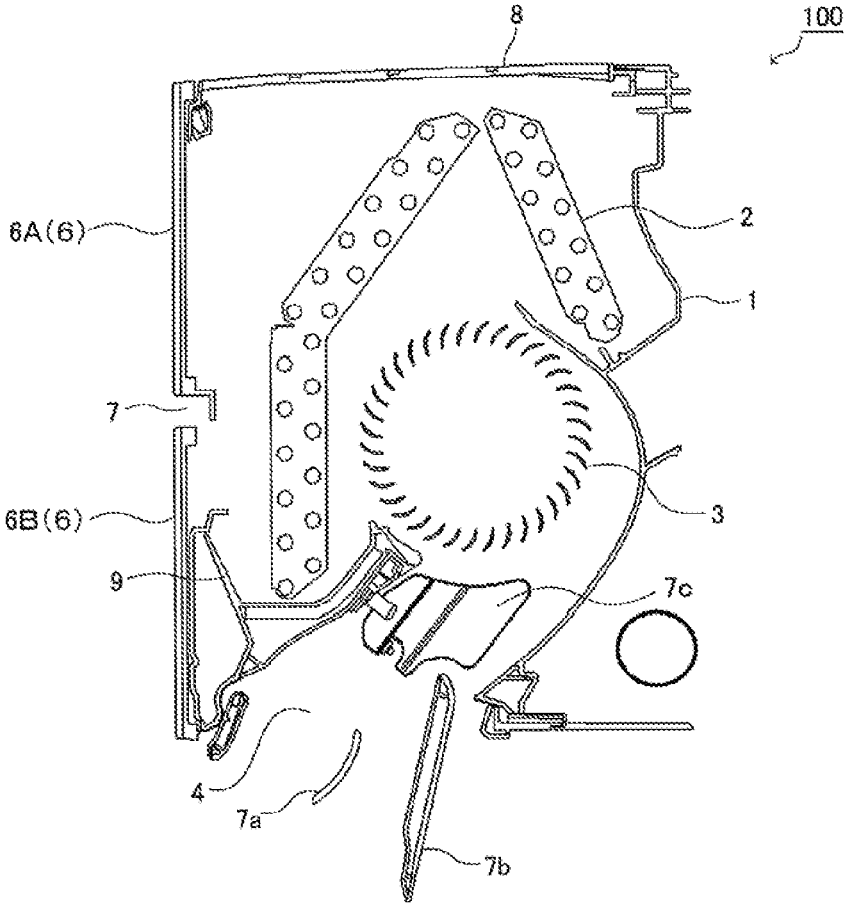

FIG. 2 is a view of an internal structure of the indoor unit 100 of an air-conditioning apparatus according to the embodiment as viewed side-on.

Figure 3:
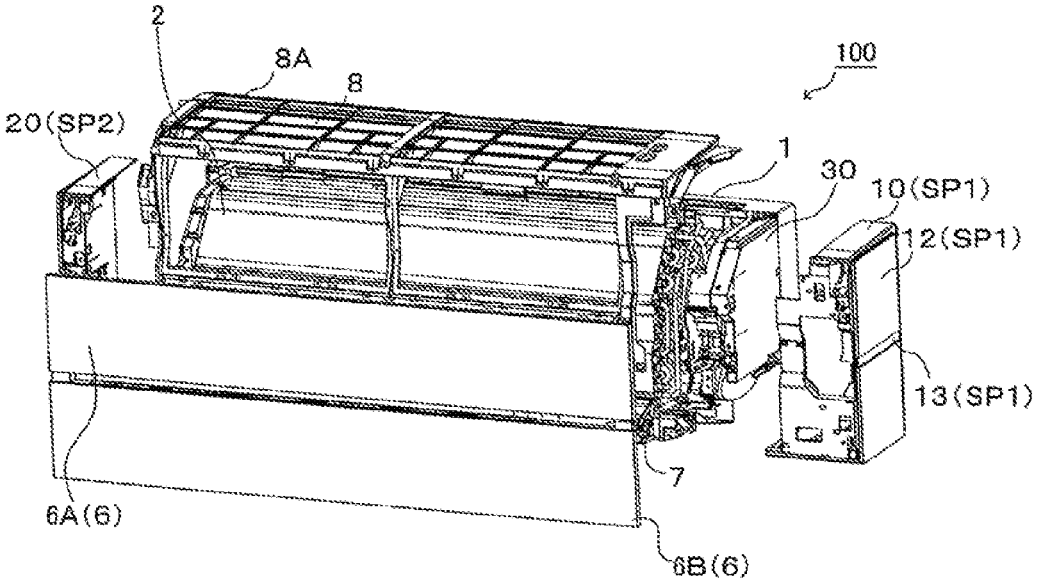
FIG. 3 is a perspective exploded view for illustrating the indoor unit of an air-conditioning apparatus according to the embodiment of the present invention.

FIG. 3 is a perspective exploded view of the indoor unit 100 of an air-conditioning apparatus according to the embodiment.

[Description of Configuration]

The indoor unit 100 includes a body casing 1, a front panel 6, a side panel SP1, and a side panel SP2. The front panel 6, the side panel SP1, and the side panel SP2 correspond to outer shell panels. In the body casing 1, an indoor heat exchanger 2, an indoor air-sending device 3, a drain pan 9, etc., are provided. The drain pan 9 is configured to accumulate, for example, dew condensation water adhering to the indoor heat exchanger 2. Further, the indoor unit 100 includes a controller (not shown) configured to control various devices.

The indoor air-sending device 3 includes a cross-flow fan, and a motor unit configured to drive the cross-flow fan. The indoor air-sending device 3 is configured to take air into the indoor unit 100, and to discharge the air to the outside of the indoor unit 100. The indoor air-sending device 3 is provided on a downstream side of the indoor heat exchanger 2. The indoor heat exchanger 2 can be made up of, for example, a fin-and-tube heat exchanger. The drain pan 9 is configured to accumulate, for example, dew condensation water adhering to the indoor heat exchanger 2.

The indoor unit 100 has, for example, a rectangular parallelepiped shape, and an air passage through which air passes is formed in an inside of the body casing 1. The indoor unit 100 includes an air outlet 4 for use in discharging air, and an air inlet 7 and an air inlet 8 both for in r taking in air.

The air inlet 7 is formed in a front surface of the body casing 1. The air inlet 7 is formed in parallel to a right-and-left direction in a longitudinal direction of the body casing 1. When the indoor unit 100 is installed on a wall of, for example, a room, the air inlet 7 is parallel to a horizontal direction. The air inlet 8 is formed in an upper part of the body casing 1. A grille portion 8A is provided in the air inlet 8 so as to extend in parallel to the horizontal direction. The grille portion 8A is provided to prevent insertion of, for example, a hand or a finger, into the air inlet 8. An airflow direction adjusting plate 7*a* and an airflow direction adjusting plate 7*b* that are rotatable are provided in the air outlet 4. Rotation shafts of the airflow direction adjusting plate 7*a* and the airflow direction adjusting plate 7*b* are parallel to a horizontal direction. The airflow direction adjusting plate 7*a* and the airflow direction adjusting plate 7*b* are rotated, as a result of which air discharged by an action of the indoor air-sending device 3 can be adjusted in an up-and-down direction. Further, airflow direction adjusting plates 7*c* that are rotatable are provided in the air outlet 4. Rotation shafts of the airflow direction adjusting plates 7*c* are orthogonal to the horizontal direction. The airflow direction adjusting plates 7*c* are rotated, as a result of which air discharged by the action of the indoor air-sending device 3 can be adjusted in a right-and-left direction.

The front panel 6 forming an outer shell of the front surface of the indoor unit 100 is attached to the body casing 1.

Also, to the body casing 1, the side panel SP1 and the side panel SP2 are attached. The side panel SP1 is provided on a right surface portion of the body casing 1 as the indoor unit 100 is viewed from a front side. The side panel SP2 is provided on a left surface portion of the body casing 1 as the indoor unit 100 is viewed from the front side.

The side panel SP1 includes a base member 10, a connecting member 11 (not shown), a design panel 12, and a band-shaped panel 13. The side panel SP2 has a configuration corresponding to that of the side panel SP1, and includes a base member 20, a connecting member (not shown), a design panel (not shown), and a band-shaped panel (not shown). As described above, the body casing 1 includes the front panel 6 and the pair of side panels on the right and left sides of the indoor unit 100.

The front panel 6 includes a first panel 6A and a second panel 6B. The first panel 6A is provided on a lower side with respect to the second panel 6B.

The first panel 6A is provided so as to extend from one side end portion of the body casing 1 to an other side end portion thereof. The second panel 6B is provided so as to extend from the one side end portion of the body casing 1 to the other side end portion thereof. The second panel 6B is provided such that an upper end thereof is located, with a predetermined gap provided between the upper end a lower end of the first panel 6A. That is, the air inlet 7 is formed between the first panel 6A and the second panel 6B. The air inlet 7 is formed so as to extend in the horizontal direction. As described above, the front surface portion of the body casing 1 is opened at a position of the gap between the first panel 6A and the second panel 6B, and can take the air into the indoor unit 100 through the gap. A front surface of the front panel 6 is a design surface, and a back surface thereof is opposite to the indoor heat exchanger 2. The base member 10 of the side panel SP1 is provided on one side end portion of a back surface of the front panel 6, and the base member 20 of the side panel SP2 is provided on an other side end portion of the back surface of the front panel 6.

The side panel SP1 is provided on the right side end portion of the front panel 6 as the indoor unit 100 is viewed from the front side. The front panel 6 and the side panel SP1 are orthogonal to each other. In this embodiment, the side panel SP1 corresponds to the side panel SP2, and hence description of the side panel SP2 is omitted. Further, description of the detailed configuration of the side panel SP1 will be given in description of FIG. 4 and subsequent drawings.

In the body casing 1, an electrical component box 30 is provided. In the electrical component box 30, for example, a controller configured to control the indoor air-sending device 3 or other components of the indoor unit 100 are provided. The electrical component box 30 is located opposite to the base member 10. The indoor heat exchanger 2 is provided on a lateral side of the electrical component box 30.

[Detailed Configuration of Side Panel SP1 and Other Members]

Figure 4:
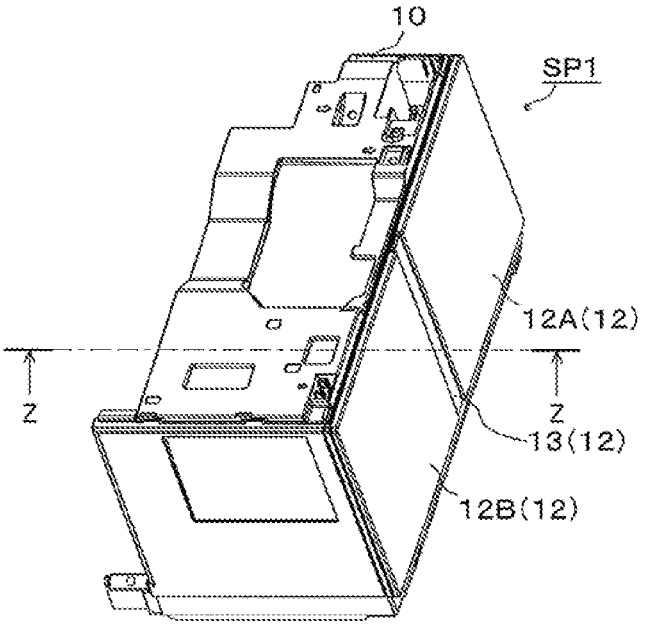
FIG. 4 is a perspective view of a side panel of the indoor unit of an air-conditioning apparatus according to the embodiment of the present invention.

FIG. 4 is a perspective view of the side panel SP1 of the indoor unit 100 of an air-conditioning apparatus according to the embodiment.

Figure 5:
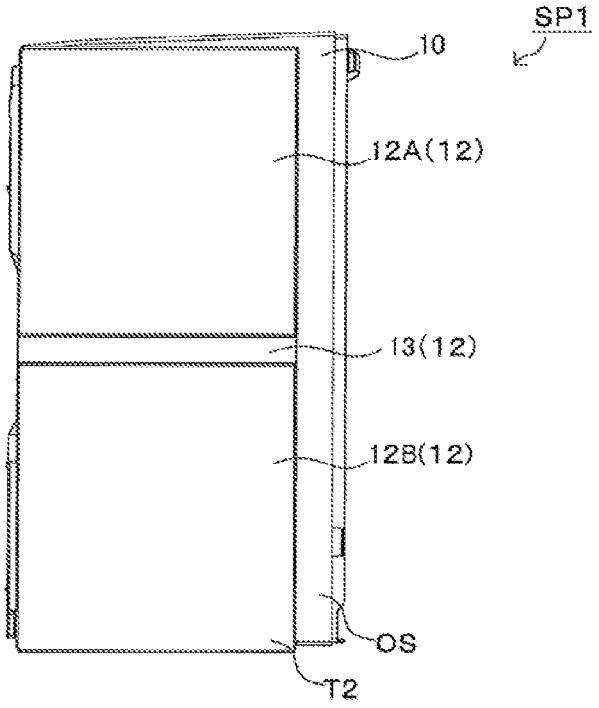
FIG. 5 is an explanatory view of a design panel and a band-shaped panel of the side panel of the indoor unit of an air-conditioning apparatus according to the embodiment of the present invention.

FIG. 5 is an explanatory view of the design panel 12 and the band-shaped panel 13 of the side panel SP1 of the indoor unit 100 of an air-conditioning apparatus according to the embodiment.

Figure 6:
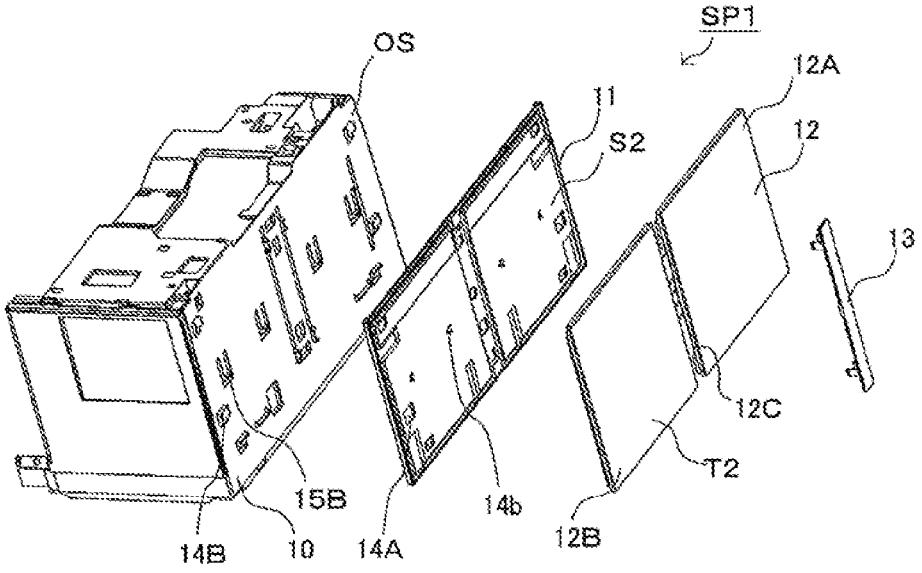
FIG. 6 is a perspective view for illustrating the side panel of the indoor unit of an air-conditioning apparatus according to the embodiment of the present invention under a state of being disassembled.

FIG. 6 is a perspective exploded view for illustrating the side panel SP1 of the indoor unit 100 of an air-conditioning apparatus according to the embodiment.

The side panel SP1 includes the base member 10, the connecting member 11, the design panel 12, and the band-shaped panel 13. The base member 10 is provided on the one side end portion of the front panel 6. The connecting member 11 is mounted to the base member 10. The design panel 12 has light transmissivity. The band-shaped panel 13 is provided at the same height position as the air inlet 7.

On the base member 10, an outer surface OS is formed as a surface to which the connecting member 11 is attached. The base member 10 is provided on the electrical component box 30. The base member 10 is fixed to, for example, the body casing 1. As fixing means therefor, for example, a bolt may be employed, or a fitting structure formed on the base member 10 and the body casing 1 may be employed. Further, the shape of the base member 10 is not limited to that illustrated in FIG. 1 to FIG. 3, and the base member 10 may be a flat-plate-shaped member.

The connecting member 11 includes a first surface S1 and a second surface S2 formed on to the opposite side of the first surface S1. The connecting member 11 is attached to the base member 10, with the first surface S1 located to face the base member 10, and is fixed to the base member 10. The connecting member 11 has, for example, a rectangular shape as seen in plan view. The connecting member 11 has a flat plate shape. Further, the connecting member 11 is a member not having light transmissivity, and a part of the base member 10, which is covered by the connecting member 11, cannot be seen.

The design panel 12 has the same shape as the connecting member 11 as seen in plan view, and has, for example, a rectangular shape. Therefore, a peripheral edge of the design panel 12 is opposite to a peripheral edge of the connecting member 11. The design panel 12 is attached to the connecting member 11 in such a way as to face the second surface S2 of the connecting member 11. Further, the design panel 12 has a flat plate shape. Further, the design panel 12 is formed of a member having light transmissivity. The design panel 12 may be transparent or translucent.

The design panel 12 includes a first surface portion 12A, a second surface portion 12B, and a connecting portion 12C. The first surface portion 12A and the second surface portion 12B each have a rectangular shape as seen in plan view. In this embodiment, the first surface portion 12A and the second surface portion 12B have the same shape. The connecting portion 12C connects the first surface portion 12A and the second surface portion 12B to each other. A front surface of the connecting portion 12C is formed to be recessed with respect to front surfaces of the first surface portion 12A and the second surface portion 12B.

The band-shaped panel 13 is located at a formation position of the connecting portion 12C of the design panel 12. The band-shaped panel 13 is provided on the design panel 12 to be stacked thereon. The band-shaped panel 13 is fixed to the connecting portion 12C while being engaged with the connecting portion 12C. The band-shaped panel 13 is located at the same level as the air inlet 7, when attached to the design panel 12. The band-shaped panel 13 is formed so as to extend from a front end of the design panel 12 to a rear end thereof, when the side panel SP1 is attached to the base member 10. Therefore, the air inlet 7 and the band-shaped panel 13 are seen as being continuous with each other, thereby improving the design of the indoor unit 100.

In the design panel 12, a portion at which the band-shaped panel 13 is attached is formed in the shape of a recess. That is, the design panel 12 has a recessed portion at the formation position of the connecting portion 12C. Therefore, with the band-shaped panel 13 attached to the design panel 12, a front surface of the design panel 12 (second surface T2 to be described later) and a front surface of the band-shaped panel 13 are aligned with each other, thereby improving the design of the indoor unit 100.

[Attachment and detachment Structure of Side Panel SP1 or Other Matters]

Figure 7:
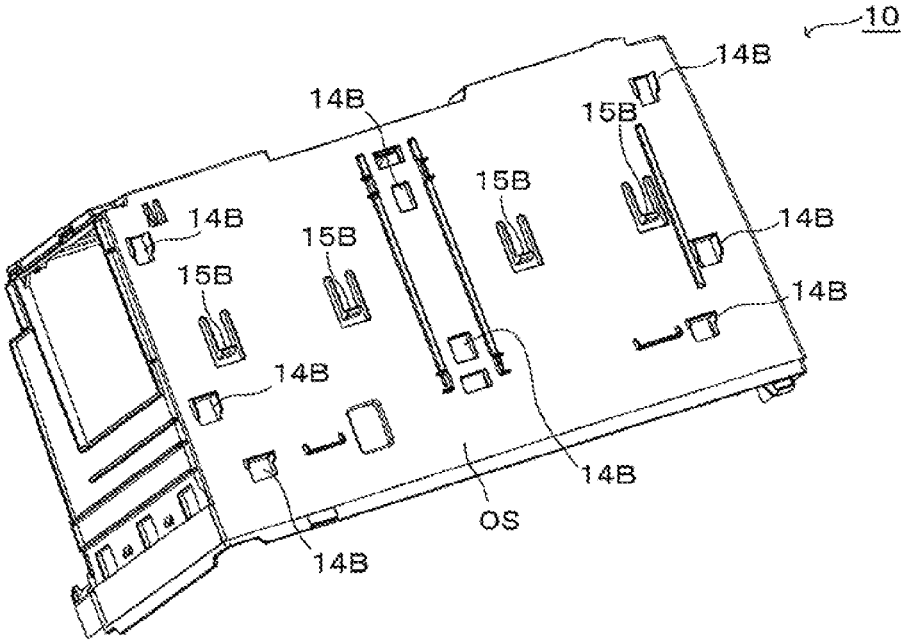
FIG. 7 is a perspective view of a base member of the indoor unit of an air-conditioning apparatus according to the embodiment of the present invention as viewed from an outer surface side.

FIG. 7 is a perspective view of the base member 10 of the indoor unit 100 of an air-conditioning apparatus according to the embodiment as viewed from an outer surface OS side.

Figure 8:
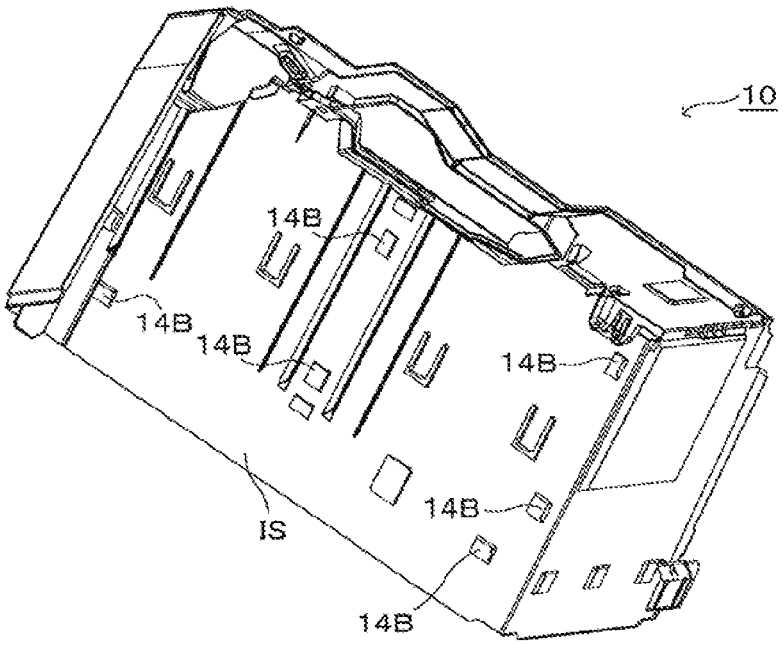
FIG. 8 is a perspective view of the base member of the indoor unit of an air-conditioning apparatus according to the embodiment of the present invention as viewed from an inner surface side.

FIG. 8 is a perspective view of the base member 10 of the indoor unit 100 of an air-conditioning apparatus according to the embodiment as viewed from an inner surface IS side.

Figure 9:
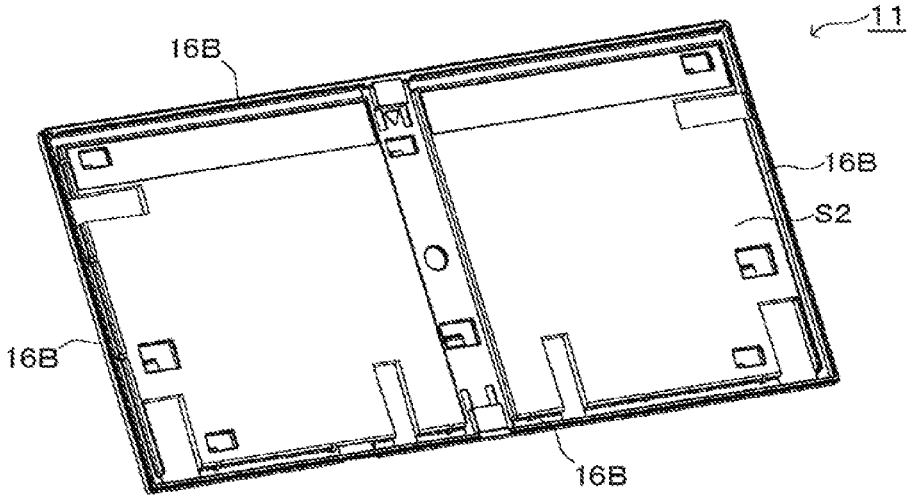
FIG. 9 is a perspective view of a connecting member of the side panel of the indoor unit of an air-conditioning apparatus according to the embodiment of the present invention as viewed from a second surface side.

FIG. 9 is a perspective view of the connecting member 11 of the side panel SP1 of the indoor unit 100 of an air-conditioning apparatus according to the embodiment as viewed from the second surface S2 side.

Figure 10:
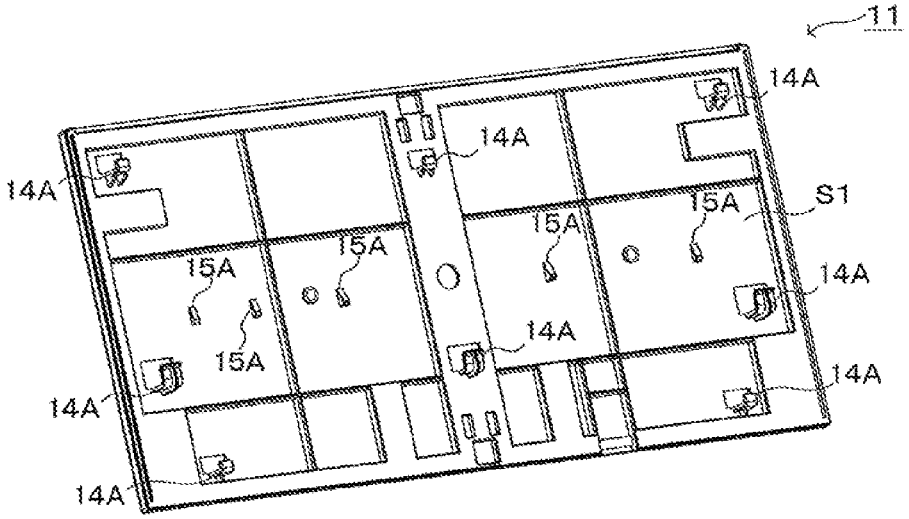
FIG. 10 is a perspective view of the connecting member of the side panel of the indoor unit of an air-conditioning apparatus according to the embodiment as viewed from a first surface side.

FIG. 10 is a perspective view of the connecting member 11 of the side panel SP1 of the indoor unit 100 of an air-conditioning apparatus according to the embodiment as viewed from the first surface S1 side.

Figure 11:
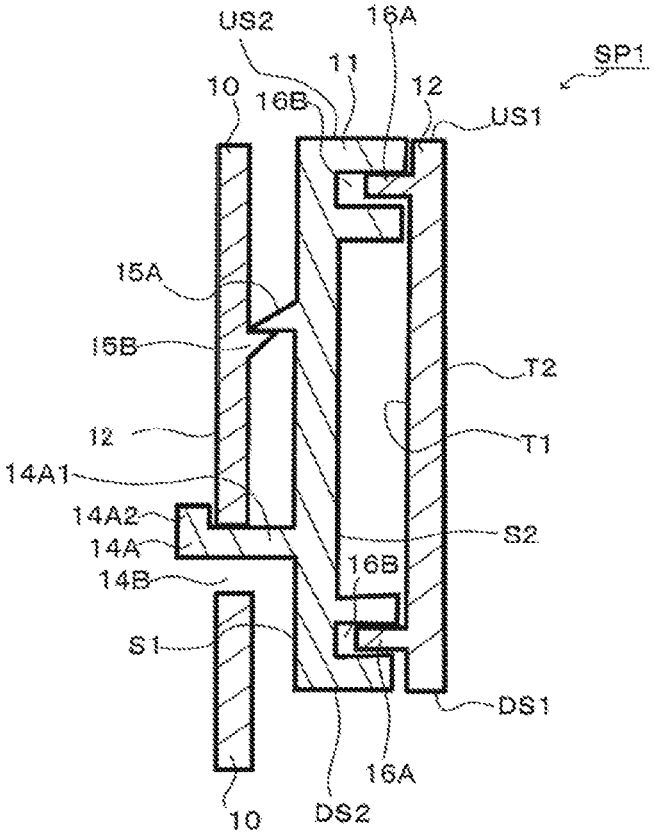
FIG. 11 is an explanatory view of a cross section taken along line Z-Z illustrated in FIG. 4.

FIG. 11 is an explanatory view of a cross section taken along the line Z-Z illustrated in FIG. 4.

On the first surface S1 of the connecting member 11, a first attachment structure to be engaged with the base member 10 is formed at a position closer to the center than to the peripheral edge. In this embodiment, this first attachment structure is as follows. The connecting member 11 has, as an attachment structure, a first claw 14A formed on the first surface S1 and a hole portion 14B. The first claw 14A includes a horizontal portion 14A1 and a vertical portion 14A2. The horizontal portion 14A1 projects from a front surface of the first surface S1 of the connecting member 11 in the horizontal direction and passes through the hole portion 14B of the base member 10. The vertical portion 14A2 projects from an end portion of the horizontal portion 14A1 in a vertically upward direction. The base member 10 has the hole portion 14B with which the first claw 14A is inserted and into which the first claw 14A is engaged. The hole portion 14B is formed at a position opposite to the first claw 14A.

Further, in addition to the first attachment structure, there is formed a second attachment structure for increasing the attachment strength of the side panel SP1 with respect to the base member 10. Specifically, a second projecting portion 15B is formed on the base member 10. The second projecting portion 15B is in contact with a first projecting portion 15A, and the second projecting portion 15B and the first projecting portion 15A are pressed against each other. With the second projecting portion 15B provided on the lower side with respect to the first projecting portion 15A, the first projecting portion 15A and the second projecting portion 15B are in contact with each other. Contact surfaces of the first projecting portion 15A and the second projecting portion 15B are, for example, horizontal surfaces. That is, the first projecting portion 15A includes the horizontal surface to be in contact with the contact surface (horizontal surface) of the second projecting portion 15B. Further, the second projecting portion 15B includes the horizontal surface to be in contact with the contact surface (horizontal surface) of the first projecting portion 15A.

The first claw 14A is formed on the connecting member 11, and the hole portion 14B is formed in the base member 10. Thus, the connection between the connecting member 11 and the base member 10 is strong. In the first attachment structure, the claw and the hole portion are engaged with each other. Thus, the connection between the connecting member 11 and the base member 10 can be easily stronger than in, for example, a structure in which a member having a projection structure formed thereon is inserted into a member having a recess structure formed therein so that the members are attached to each other. Where the claw is formed on the peripheral edge of the connecting member 11, there is a case where the strength of the claw and a periphery thereof is reduced. In this embodiment, the first attachment structure is formed not on the peripheral edge of the connecting member 11 but at a position closer to the center than to the peripheral edge. As a result, the connection between the connecting member 11 and the base member 10 can be strong while preventing the reduction of the strength of the connecting member 11. The horizontal portion 14A1 of the first claw 14A is inserted into the hole portion 14B, as a result of which the attachment strength of the side panel SP1 in the up-and-down direction and the right-and-left direction can be improved.

The side panel SP1 has the first projecting portion 15A and the second projecting portion 15B, and thus, in particular, the attachment strength of the side panel SP1 in the downward direction can be increased. For example, even when the connecting member 11 is moved in the downward direction, the first projecting portion 15A interferes with the second projecting portion 15B of the base member 10 so that movement of the connecting member 11 toward the lower side is restricted. Thus, the connecting member 11 can be prevented from being detached from the base member 10.

The first attachment structure and the second attachment structure are not formed on the peripheral edge of the side panel SP1 but at the positions closer to the center of the side panel SP1 than to the peripheral edge. However, the connecting member 11 is formed of a member having no light transmissivity, and further, the first attachment structure and the second attachment structure are formed on the first surface S1. Thus, the first attachment structure and the second attachment structure cannot be seen through the design panel 12. Therefore, it is possible to prevent worsening of the design of the indoor unit 100 of an air-conditioning apparatus according to the embodiment.

Incidentally, there has been known means for hiding the attachment structure, etc., by providing a sheet inward of a light transmissive member without providing the connecting member 11 as in related-art indoor units. However, in this means, since the connecting member 11 is not provided, in the light transmissive member, a formation position of an attachment portion with respect to the base member is located at a peripheral edge thereof. As a result, the attachment strength between the light transmissive member and the base member cannot be easily ensured. One surface (first surface S1) of the connecting member 11 contributes to the attachment strength between the connecting member 11 and the base member 10. An other surface (second surface S2) of the connecting member 11 does not have light transmissivity, and hence contributes to the design. That is, the connecting member 11 of the indoor unit 100 contributes to both the attachment strength and the design; that is, this single member satisfies those requirements at the same time.

As illustrated in FIG. 11, the design panel 12 includes a first surface T1, and a second surface T2 formed on a side opposite to the first surface T1. The design panel 12 is attached to the connecting member 11, with the first surface T1 located to face the connecting member 11, and is fixed to the connecting member 11. The second surface T2 is an outer front surface of the design panel 12.

A projection-and-recess structure for attaching the design panel 12 to the connecting member 11 is formed on the peripheral edge of the second surface S2 of the connecting member 11 and the peripheral edge of the design panel 12. In this embodiment, this projection-and-recess structure is as follows.

On the peripheral edge of the design panel 12, a projecting portion 16A (projection structure) is formed to project from the design panel 12 to the connecting member 11. The projecting portion 16A may be continuously formed in an annular shape, or be formed in such an intermittent manner as to have cut portions. Further, in the second surface S2 of the connecting member 11, there is formed a recessed portion 16B (recess structure) into which the projecting portion 16A is to be inserted. The projecting portion 16A of the design panel 12 is formed at a position opposite to the recessed portion 16B of the connecting member 11. In this embodiment, the projection structure is formed on the design panel 12, and the recess structure is formed in the connecting member 11. However, the present invention is not limited to such a structure. The recess structure may be formed in the design panel 12, and the projection structure may be formed on the connecting member 11.

The projection-and-recess structure is formed on the peripheral edge of the second surface S2 of the connecting member 11 and the peripheral edge of the design panel 12, and thus the design panel 12 can be attached to the connecting member 11. The design panel 12 and the connecting member 11 have the same shape as seen in plan view. That is, the peripheral edge of the design panel 12 is opposite to the peripheral edge of the connecting member 11. Therefore, when the design panel 12 attached to the connecting member 11, positions of an upper end surface US1 of the design panel 12 and an upper end surface US2 of the connecting member 11 in the height direction coincide with each other. Further, when the design panel 12 is attached to the connecting member 11, positions of a lower end surface DS1 of the design panel 12 and a lower end surface DS2 of the connecting member 11 in the height direction also coincide with each other. Moreover, although not illustrated, the same is true of positions of front and rear side end surfaces of the design panel 12 and front and rear side end surfaces of the connecting member 11. That is, positions of a peripheral surface of the design panel 12 and a peripheral surface of the connecting member 11 in the height direction or front-and-back direction coincide with each other. Therefore, when the design panel 12 is to be detached from the connecting member 11, it is necessary to separate the design panel 12 and the connecting member 11 away from each other by, for example, inserting a nail of a finger between the upper end surface US1 and the upper end surface US2. Therefore, the design panel 12 is not easily detached from the connecting member 11. That is, although the claw, the hole portion, or other structures are not employed in the connection between the design panel 12 and the connecting member, the design panel 12 is not easily detached from the connecting member 11.

The projection-and-recess structure is not formed at the center of the side panel SP1 but at the peripheral edge thereof. Therefore, even when the design panel 12 is formed of a member having light transmissivity, and the projection-and-recess structure is seen through the design panel 12, the projection-and-recess structure is not conspicuous. Therefore, the design of the indoor unit 100 of an air-conditioning apparatus according to the embodiment can be prevented from being worsened.

In the indoor unit 100 of an air-conditioning apparatus according to the embodiment, description is given with respect to a mode in which all of the first attachment structure, the second attachment structure, and the projection-and-recess structure described above are formed. However, the present invention is not limited to the mode. That is, the side panel SP1 includes the connecting member 11, but at least one of the first attachment structure, the second attachment structure, and the projection-and-recess structure or all of those may be omitted. For example, instead of using the first attachment structure, the second attachment structure, and the projection-and-recess structure, using an adhesive, the connecting member 11 and the base member 10 may be connected to each other, and the design panel 12 and the connecting member 11 may be connected to each other. Even in this mode, a part of the base member 10 is covered with the connecting member 11 not having light transmissivity. Thus, the structure of the base member 10 can be prevented from being seen through the design panel 12, as a result of which the design of the indoor unit 100 can be prevented from being worsened.

The invention claimed is:

1. An indoor unit of an air-conditioning apparatus, comprising: a body casing for receiving an indoor fan configured to take in air and an indoor heat exchanger configured to exchange heat between refrigerant and the air taken in by the indoor fan; and an outer shell panel attached to the body casing, wherein the outer shell panel includes:

a front panel provided on a front surface portion of the body casing; and side panels provided on side surface portions of the body casing, the side panels each include:

a base member provided on a side end portion of the front panel;

a connecting member having a flat plate shape and no light transmissivity, and wherein the connecting member includes a first surface and a second surface, which is formed on a side opposite to the first surface, the connecting member is attached to the base member, and the first surface is located to face the base member;

a design panel having a flat plate shape and light transmissivity, the design panel being attached to a peripheral region of the connecting member to be opposite to the second surface of the connecting member, and a band-shaped panel attached to the design panel to be stacked on the design panel, the design panel includes:

a first surface portion, a second surface portion, and a connecting portion connecting the first surface portion and the second surface portion, the band-shaped panel is fixed to the connecting portion, and is formed to extend from a front end of the design panel to a rear end thereof, and the connecting portion of the design panel is recessed with respect to the first surface portion and the second surface portion, wherein an outer front of the design panel and a front surface of the band-shaped panel are aligned with each other, when the band-shaped panel is attached to the design panel.

2. The indoor unit of an air-conditioning apparatus of claim 1, wherein the front panel includes:

a first panel section; and a second panel section located so that a gap is provided between the second panel section and the first panel section, the gap is provided to enable air to be taken into the indoor unit through the gap, and the band-shaped panel is horizontally aligned with the gap, when the band-shaped panel is attached to the design panel.

* * * * *